United States Patent [19]

Yamanaka et al.

[11] 4,424,429

[45] Jan. 3, 1984

[54] CONTACTOR FOR VACUUM TYPE CIRCUIT INTERRUPTER

[75] Inventors: Takashi Yamanaka; Kouichi Inagaki; Eizo Naya; Michinosuke Demizu; Mitsuhiro Okumura, all of Amagasaki, Japan

[73] Assignee: Mitsubishi Denki Kabushiki Kaisha, Tokyo, Japan

[21] Appl. No.: 335,836

[22] Filed: Dec. 30, 1981

[30] Foreign Application Priority Data

Sep. 16, 1981 [JP] Japan ..... 56-147545

[51] Int. Cl.[3] ..... H01H 1/04

[52] U.S. Cl. ..... 200/264; 200/266

[58] Field of Search ..... 200/262–266; 428/557, 552, 673, 674; 75/232, 247

[56] References Cited

U.S. PATENT DOCUMENTS

| | | | |
|---|---|---|---|
| Re. 30,052 | 7/1979 | Davies et al. | 200/266 X |
| 2,200,855 | 5/1940 | Ruben | 75/232 |
| 2,247,754 | 7/1941 | Hensel et al. | 200/266 X |
| 2,975,256 | 3/1961 | Lee et al. | 200/144 R |
| 3,683,138 | 8/1972 | Nabae et al. | 200/144 B |
| 4,011,052 | 3/1977 | Davies | 200/266 X |
| 4,131,458 | 12/1978 | Satoh et al. | 200/266 X |
| 4,204,863 | 5/1980 | Schreiner | 200/265 X |

FOREIGN PATENT DOCUMENTS

| | | | |
|---|---|---|---|
| 244304 | 1/1963 | Australia | 200/262 |
| 55-16315 | 2/1980 | Japan | 200/263 |
| 56-45521 | 4/1981 | Japan | 200/266 |
| 614372 | 12/1948 | United Kingdom | 200/265 |

*Primary Examiner*—John W. Shepperd
*Assistant Examiner*—Ernest G. Cusick
*Attorney, Agent, or Firm*—Oblon, Fisher, Spivak, McClelland & Maier

[57] ABSTRACT

A contactor for a vacuum type circuit interrupter having a pair of detachable electrodes in a vacuum chamber comprises an electrode obtained by melting or sintering a composition of an electric conductive metal of copper or silver as a main component and at least one metal oxide having a melting point lower than that of said conductive metal of bismuth oxide, thallium oxide, indium oxide, antimony oxide or tellurium oxide as an additive, in vacuum or a reduced atmosphere or a nonoxidative atmosphere.

7 Claims, 5 Drawing Figures

RELATION OF CHOPPED CURRENT AND CONTENT OF Bi OR $Bi_2O_3$

RELATION OF CHOPPED CURRENT AND CONTENT OF Bi OR $Bi_2O_3$

RELATION OF CHOPPED CURRENT AND TIMES FOR SWITCHING LOAD CIRCUIT 600A

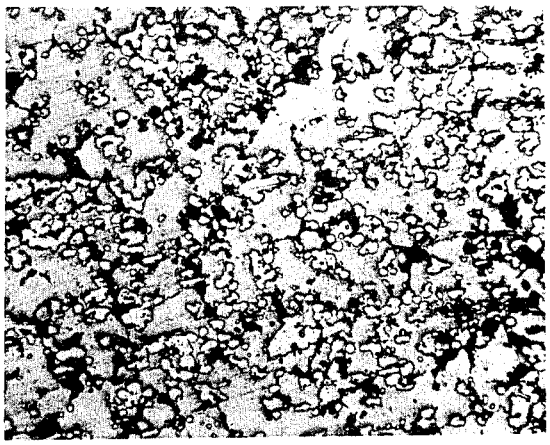
FIG. 4 200μm
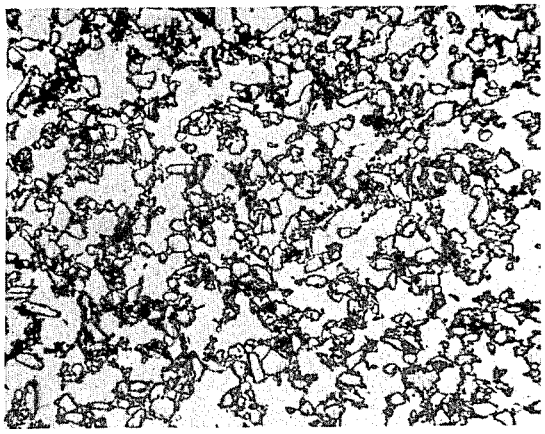
FIG. 5 200μm

CONTACTOR FOR VACUUM TYPE CIRCUIT INTERRUPTER

BACKGROUND OF THE INVENTION

1. Field of the Invention

The present invention relates to a contactor for a vacuum type circuit interrupter having low chopped current and excellent operating characteristic.

2. Description of the Prior Art

It has been known, as such contactor, to use a composition of an electric conductive metal of Cu-Bi, Cu-Pb or Cu-Sb and a low melting point metal or a composition of the electric conductive metal, the low melting point metal and a high melting point metal of Cu-Co-Bi, Cu-W-Te or Cu-Cr-Bi as a sub-component. It has been also known to incorporate a metal oxide or metal carbide having a high melting point and excellent thermionic emission and low work function such as Ag-BaO, Cu-MgO, Ag-$ThO_2$ or Ag-WC.

In the description, the components are referred by symbols of elements and each content (wt.%) is shown in ( ) followed by the symbol of element.

When a low melting point metal is used, the metal is vaporized at high rate in arching, whereby a chopped current for interrupting a current before a natural zero point can be lower. Therefore, the vapor of the low melting point metal of relatively high concentration adversely affects in the interruption of a large current whereby the interrupting current is disadvantageously low. Even though such disadvantage is reduced by an incorporation of a high melting point metal to increase the melting point of the base metal, it is not so effective. In the conventional manner, it has been possible to obtain a contactor having remarkably low chopped current of 1 A or less by incorporating 15 to 20% of a low melting point metal though the interrupting current is small. However, the chopped current gradually increases over 1 A by repeated switchings of a load current for many times. This is serious disadvantage. The contactor is usually fixed on an electrode rod by brazing. When it contains 15 to 20% of a low melting point metal, the low melting point metal contaminates a solder to remarkably reduce a strength of the brazed part. Thus, the mechanical durability as a vacuum type circuit interrupter is inferior.

When a contactor containing a low melting point metal is prepared by a melting process or a sintering process, the melting point of the component is remarkably different from the melting point of copper whereby the low melting point metal is vaporized at high rate in the process for preparation. Thus, it has considered to increase a content of the low melting point metal. However, it has been difficult to obtain stable quality because of variance of a content of the low melting point metal caused by slight variance of a temperature in the melting or sintering.

On the other hand, when a metal oxide or a metal carbide having excellent thermionic emission and low work function, is incorporated, electron is fed from it at high rate whereby a low chopped current can be given. However, the material which easily emits electron has fatal defect to be substantially incapable of interruption of a large current together with remarkably low heat conductivity. The metal oxide is usually remarkably hard to have inferior processability.

Moreover, the metal oxides having excellent thermionic emission and low work function are usually materials having high melting point of 2000° C. or higher and are not easily wet a metal, whereby dust of the material is formed in each switching of a load current to cause inferior withstand voltage characteristic. In brief, when a low melting point metal is incorporated, the interrupting current is small and the chopped current gradually increases by repeated switchings of a load current for many times and a brazing property and a mechanical strength are inferior. When the metal oxide having excellent thermionic emission and high work function is incorporated, the interrupting current is low and the processability is not good and the withstand voltage characteristic is inferior.

SUMMARY OF THE INVENTION

It is an object of the present invention to overcome the aforementioned disadvantages. Another object of the present invention is to provide a contactor for a vacuum type circuit interrupter having low chopped current, excellent stability for a long time and high interrupting current and having good brazing property and high mechanical strength.

The foregoing and other objects of the present invention have been attained by providing a contactor for a vacuum type circuit interrupter having a pair of detachable electrodes in a vacuum chamber which comprises an electrode obtained by melting or sintering a composition of an electric conductive metal of copper or silver as a main component and at least one metal oxide having a melting point lower than that of said conductive metal of bismuth oxide, thallium oxide, indium oxide, antimony oxide or tellurium oxide as an additive, in vacuum or a reduced atmosphere or a nonoxidative atmosphere.

BRIEF DESCRIPTION OF THE DRAWINGS

FIG. 4 is a metallographic photography of the conventional contactor by using Cu(60)-Cr(25)-Bi(15); and FIG. 5 is a metallographic photography of the contactor of the present invention.

DETAILED DESCRIPTION OF THE PREFERRED EMBODIMENTS

Figure 1:
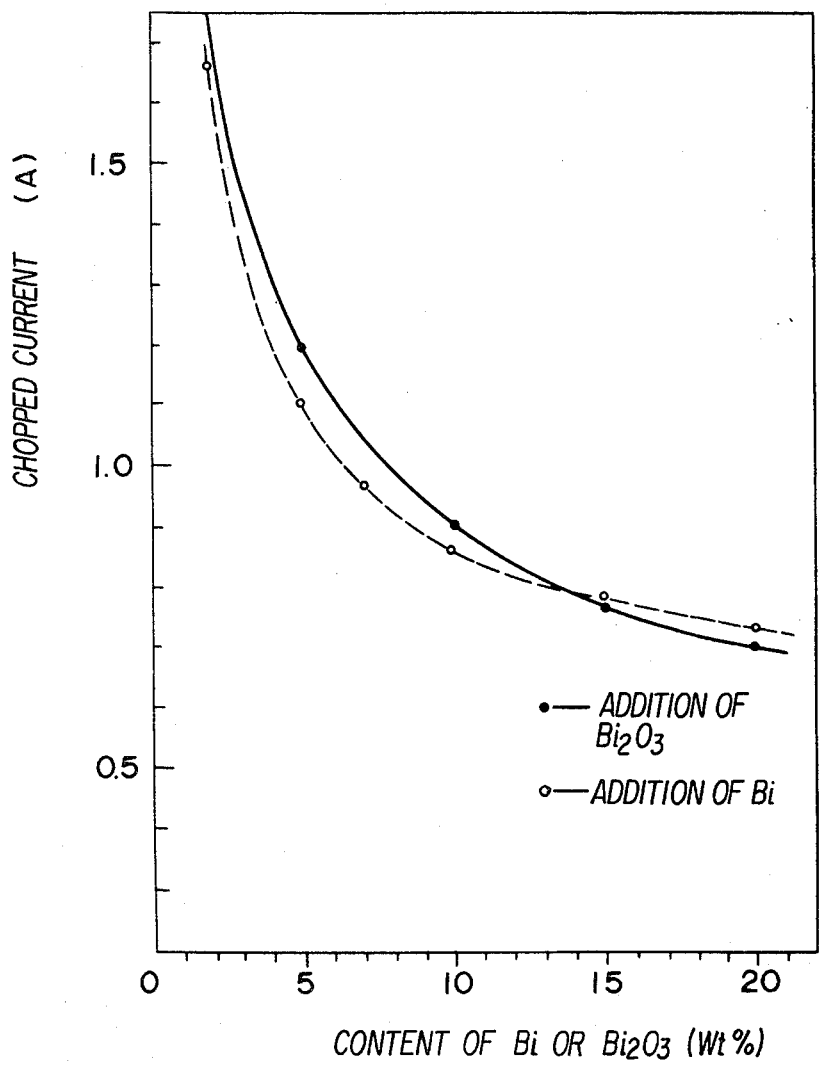
FIG. 1 is a characteristic diagram showing variation of an average chopped current in variation of a content of Bi or $Bi_2O_3$ in a range of 2 to 20 wt.% in the preparation of contactors obtained by incorporating $Bi_2O_3$ into Cu and Cr at 25 wt.% of Cr together with a conventional contactor obtained by incorporating Bi into Cu and Cr.

The metallographic photography of the conventional contactor containing a low melting point metal is shown in FIG. 4. A mixture of Cu(60)-Cr(25)-Bi(15) was charged and molded and sintered at 1000° C. for 2 hours. In the photograph, rough grains of circular Bi in black are dispersed to be discontinuously distributed and the grains of Bi are placed at parts contacting grey grains of Cr and white grains of Cu. The fine particles of Bi are uniformly dispersed at the time of mixing but are melt-flowed at high temperature of 1000° C., and solidified to form the rough grains. The melting point of Bi is 273° C. During the heating in the sintering, the shrink sintering of the molded product is not initiated at the temperature and accordingly, the molten Bi, is easily meltflowed in spaces to form rough molten grains at 700°–800° C. for the initiation of shrinkage and the shape of the rough molten grains are spherical at 1000° C. to complete the sintering.

The conventional contactor of Cu(60)-Cr(25)-Bi(15) has a low initial chopped current as about 0.7 A. However, the chopped current increased to 1.5 A by repeatedly switching a current of 600 A for 10,000 times. The interruption characteristic of an electrode having a diameter of 36 mm was about 11 kA r.m.s. The upper limit of the interrupting current is limited because of a large vaporization of Bi caused by exposing the Bi grains to the arc. The chopped current is raised because of selective vaporization of Bi from the surface of the contactor by switching a load current and insufficient supply phenomenon for newly melting Bi grains from deeper portions under discontinuous distribution of the rough Bi grains.

The rough Bi grains may be formed, because of great difference of the melting points of the main component and Bi.

The inventors have studied structures by using Te(450° C.), Sb(631° C.) (the temperature is the melting point) having relatively higher melting point than that of Bi. Thus, the disadvantages of the solidification after melt-flowing, the low interrupting current caused by selective vaporization, and the increase of the chopped current could not be overcome. The inventors have further studied the incorporation of a low melting point metal oxide. If only low melting point metal is remained in the contactor by removing oxygen component at the time of completion of the sintering, the melt-flowability can be controlled in the form of the oxide having higher melting point during the sintering. The dissociation of the oxide is attained by selecting the material and melting or sintering in a nonoxidative atmosphere.

Certain examples of the present invention will be illustrated.

An electrolytic copper powder as a main component, a chromium powder as a sub-component and $Bi_2O_3$ powder as an additive were mixed to give Cu(60)-Cr(25)-$Bi_2O_3$(15) and the mixture was compressed and sintered at 1000° C. for 2 hours in a nonoxidative atmosphere in a vacuum furnace or a high purity hydrogen furnace. The metallographic photograph of the sintered product is shown in FIG. 5. The fine uniform Bi layer is distributed in a continuous network form. Rough Bi grains are not substantially found. Most of Bi grains are placed in the form of close contact with Cu grains. This feature is attained because of the melting point $Bi_2O_3$ of 817° C. In the heating for the sintering, $Bi_2O_3$ is not melted at a temperature of below about 817° C. to maintain the fine uniform distribution in the mixing. At the melting point, the shrink sintering of the molded product is initiated to shrink under holding the $Bi_2O_3$ powder. At higher than 817° C., the $Bi_2O_3$ powder initiates its melting. Thus, the movement of the molten $Bi_2O_3$ is highly controlled in comparison with that of the molten Bi whereby rough grains are not formed by the solidification.

The molten $Bi_2O_3$ is converted into Bi by heating it to higher temperature to receive dissociation energy. The dissociation of oxygen is accelerated in the presence of Cu or Cr in contact in a nonoxidative atmosphere. At the completion of the sintering, the network of Bi maintaining the fine uniform distribution at the mixing and a small amount of $Bi_2O_3$ is remained. The phenomenon is given in broad range of the components of Cu-Cr-$Bi_2O_3$. When a content of $Bi_2O_3$ is more than 30 wt.%, the sintering is not completed to increase the residual $Bi_2O_3$.

The properties of the contactor of the present invention will be illustrated in comparison with those of the conventional contactor.

FIG. 1 shows chopped current characteristics of various samples of the conventional product of Cu-Cr-Bi and the product of the invention of Cu-Cr-$Bi_2O_3$ obtained by incorporating Bi or $Bi_2O_3$ at a content of 2 to 20% into Cu and Cr at a content of Cr of 25 wt.%. Each electrode having a diameter of 36 mm is assembled in the vacuum type circuit interrupter which is repeatedly switched in the current of 600 A for 1,000 times. Average chopped current in interruption of a resistance circuit passing 20 A peak is measured and plotted on the ordinate and the content is plotted on the abscissa. When the content is quite small, the chopped current is lower in the case of the incorporation of Bi. This is considered as follows. The solidified Bi grains is contributed and the Bi component still remains in the switching for about 1,000 times. When the content is over 15 wt.%, the relation is reversed. This is considered as follows. The gaps between the solidified grains are relatively larger than a diameter of arc spots whereby the arcing is sometimes distinguished in the gaps to increase an average chopped current. In the case of the incorporation of $Bi_2O_3$, the fine uniform distribution is given whereby such phenomenon is less to give low average chopped current.

The tendency of saturation is found at a content of higher than 15 wt.% and the effect for reducing the chopped current is not remarkably increased at a content of 20 wt.% or more.

Figure 2:
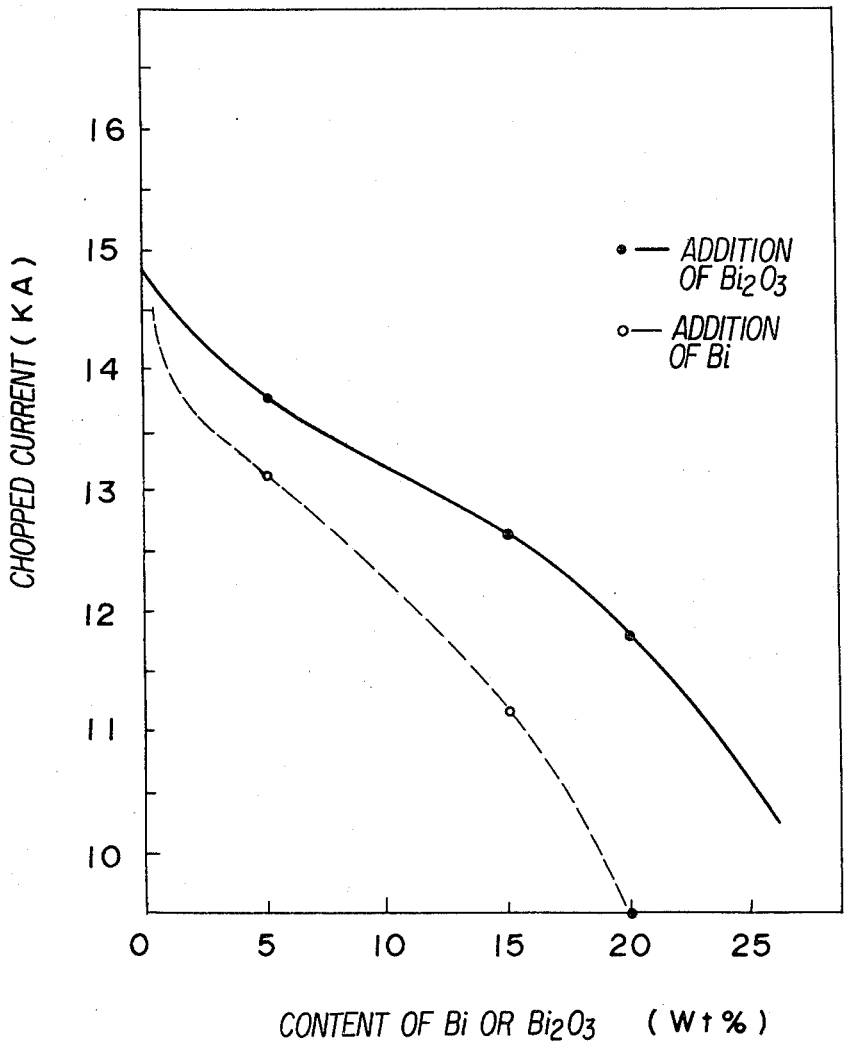
FIG. 2 is a characteristic diagram showing variation of upper limit of interruptable current in variation of a content of Bi or $Bi_2O_3$.

FIG. 2 shows the variation of the interrupting current in variation of a content with each electrode having a diameter of 36 mm in the 7.2 kV circuit. The upper limit in capable of interruption is shown. The interrupting characteristic is remarkably lowered depending upon increase of a content of Bi. This is considered as follows. The solidified rough Bi grains are vaporized at high rate by applying large current arcing whereby the interrupting characteristic is lowered. In the case of the incorporation of $Bi_2O_3$, there is not rough Bi grain and the fine Bi is uniformly distributed whereby the vaporization is reduced and the tendency for deterioration of interrupting characteristic is prevented. The interrupting characteristic in the case of the incorporation of $Bi_2O_3$ at a content of 20 wt.% is superior for about 120% to that of the incorporation of Bi.

Figure 3:
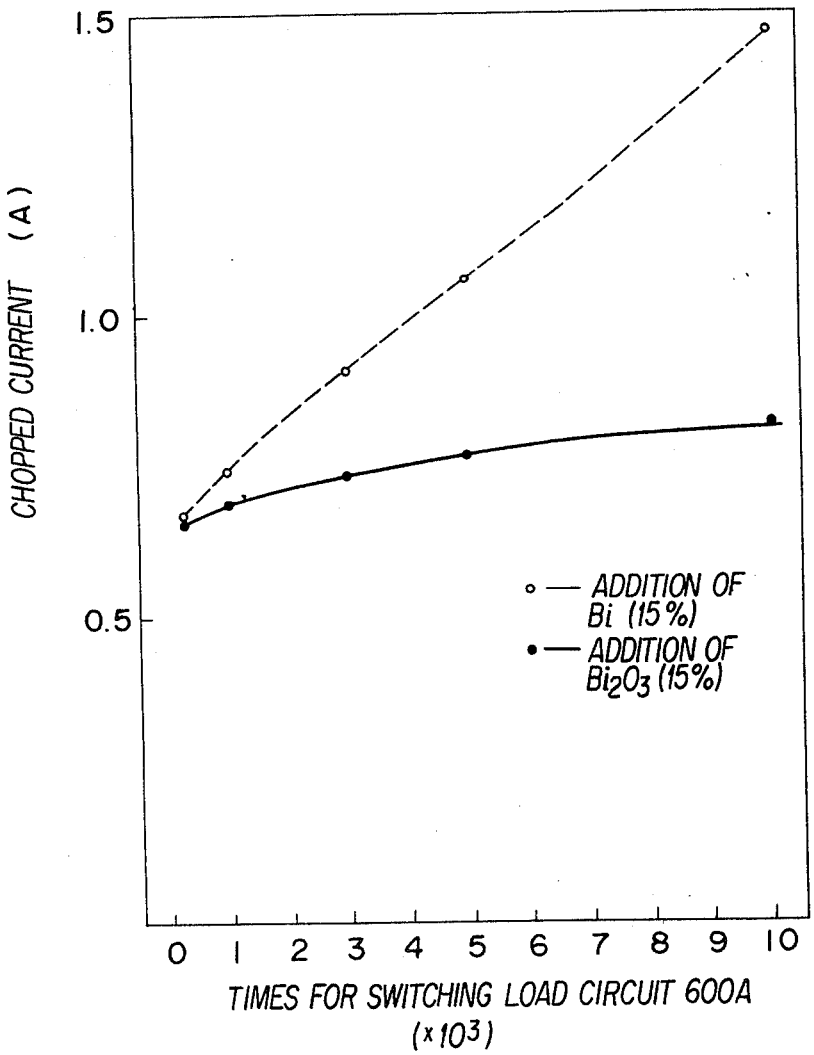
FIG. 3 is a characteristic diagram showing variation of an average chopped current after switching a load current of contactors obtained by using each composition having a content of 15 wt.% of Bi or 15 wt.% of $Bi_2O_3$.

FIG. 3 shows the variation of the chopped current by switching a load current for many times in the case of the conventional contactor obtained by using Cu(60)-Cr(25)-Bi(15) and the contactor of the present invention obtained by using Cu(60)-Cr(25)-$Bi_2O_3$(15).

The chopped current of the contactor obtained by the incorporation of Bi is substantially the same as that of the incorporation of $Bi_2O_3$ at the initial state, but it increases depending upon the switchings of the load current. The chopped current of the former is over 1 A after switchings for 4,000 times, and is about 1.5 A after switchings for 10,000 times. On the other hand, the chopped current of the latter only slightly increases by switchings and is only 0.83 A after switchings for 10,000 times. This is considered as follows. The contactor of the present invention obtained by the incorporation of $Bi_2O_3$ which has fine uniformly distributed continuous Bi layer has Bi components at all parts of the surface of the contactor and the Bi layer continued in the thickness direction is newly melted when the surface temperature is raised by arc spots to supply Bi component.

In the examples, the combination of Cu, Cr and $Bi_2O_3$ has been illustrated. When $Ti_2O_3$, $In_2O$, $Sb_2O_3$ or $TeO_2$ is used as the low melting point metal oxide, the same effect is found. When W, Mo, Co or Fe is used instead of Cr, the same effect is also found.

In the combination of Cu(67)-Cr(25)-$Bi_2O_3$(5)-$Bi_2Te_3$(3) at a content of 5 wt.% of $Bi_2O_3$ and a content of 3 wt.% of $Bi_2Te_3$, the stability of the chopped current is higher than that of the combination of Cu(67)-Cr(25)-Bi(8). The interruption characteristic of the former is also superior to that of the later.

Certain adverse effect of the residual $Bi_2O_3$ remained after the sintering to generate oxygen gas in the interruption of a large current is considered. Therefore, a contactor obtained by the combination of Cu(57)-Cr((25)-$Bi_2O_3$(15)-$TiTe_2$(3) is tested. The interrupting characteristic is further improved for several % because the active Ti formed by the decomposition by arcing is diffused from the electrode space under effectively absorbing oxygen gas formed by the decomposition.

In accordance with the present invention, the contactor is prepared by incorporating the low melting point metal oxide and sintering in a nonoxidative atmosphere, the fine low melting point metal is uniformly distributed in the form of the continuous network whereby the contactor for vacuum type circuit interrupter having excellent large current interrupting characteristic with a low chopped current can be obtained. The formation of rough grains of the low melting point metal is prevented, whereby the decrease of the mechanical strength caused by brasing the contactor on an electrode rod is minimized in comparison with the conventional contactor.

We claim:

1. A contactor for a vacuum type circuit interrupter having a pair of detachable electrodes in a vacuum chamber which comprises an electrode obtained by sintering a composition comprising an electric conductive metal which is copper or silver as a main component and at least one metal oxide having a melting point lower than that of said conductive metal, said metal oxide being bismuth oxide, thallium oxide, indium oxide, antimony oxide or tellurium oxide, as an additive, in vacuum or a reduced atmosphere or a nonoxidative atmosphere with the resulting formation of a uniformly distributed continuous network of the metal of the metal oxide in the electrode.

2. A contactor for a vacuum type circuit interrupter having a pair of detachable electrodes in a vacuum chamber which comprises an electrode obtained by sintering a composition comprising an electric conductive metal which is copper or silver as a main component, comprising an arc resistant metal having a melting point higher than that of said conductive metal, said arc resistant metal being chromium, molybdenum, tungsten, iron or cobalt, as a sub-component and at least one metal oxide, having a melting point lower than that of said conductive metal, said metal oxide being bismuth oxide, thallium oxide, indium oxide, antimony oxide or tellurium oxide as an additive, in vacuum or a reduced atmosphere or a nonoxidative atmosphere with the resulting formation of a uniformly distributed continuous network of the metal of the metal oxide in the electrode.

3. The contactor for a vacuum type circuit interrupter according to claim 1 or 2, wherein a low melting point metal, alloy or intermetallic compound is incorporated as a sub-additive in said electrode.

4. The contactor for a vacuum type circuit interrupter according to claim 3 wherein a titanium metal, alloy or intermetallic compound is incorporated as a sub-additive in said electrode.

5. The contactor for a vacuum type circuit interrupter according to claim 1 or 2 wherein a titanium metal, alloy or intermetallic compound is incorporated as a sub-additive in said electrode.

6. The contactor of claim 1 wherein the metal oxide having a melting point lower than that of said conductive oxide is $Bi_2O_3$ in amounts of 2 to 30% by weight.

7. A contactor for a vacuum type circuit interrupter according to claim 1 having a pair of detachable electrodes in a vacuum chamber which comprises an electrode obtained by sintering in a nonoxidative atmosphere a composition comprising an electric conductive metal which is copper as a main component and bismuth oxide as a metal oxide having a melting point lower than that of said conductive metal at a temperature and for a time sufficient to decompose the bismuth oxide and liberate bismuth with the resulting formation of a uniformly distributed continuous network of the bismuth in the electrode.

* * * * *